United States Patent [19]

Kehrer et al.

[11] 4,346,758

[45] Aug. 31, 1982

[54] HEAT EXCHANGER FOR COOLING SLAG-CONTAINING GASES FROM COAL GASIFICATION

[75] Inventors: Wolfgang Kehrer; Helmut Lachmann, both of Berlin, Fed. Rep. of Germany

[73] Assignee: Borsig GmbH, Berlin, Fed. Rep. of Germany

[21] Appl. No.: 98,390

[22] Filed: Nov. 29, 1979

[30] Foreign Application Priority Data

Apr. 3, 1979 [DE] Fed. Rep. of Germany ..... 2913748

[51] Int. Cl.[3] ..... F28F 9/22

[52] U.S. Cl. ..... 165/134 R; 165/158; 432/90

[58] Field of Search ..... 165/141, 140, 144, 145, 165/158, 134; 432/66, 90, 222

[56] References Cited

U.S. PATENT DOCUMENTS 1,710,712 4/1929 Reavis ..... 165/140

3,820,598 6/1974 Fenger et al. ..... 165/160

FOREIGN PATENT DOCUMENTS 214477 7/1941 Switzerland ..... 432/222

*Primary Examiner*—Samuel Scott

*Assistant Examiner*—Theophil W. Streule, Jr.

*Attorney, Agent, or Firm*—Becker & Becker, Inc.

[57] ABSTRACT

A tube bundle heat exchanger having an additional tube bottom with insertion tubes arranged in the inlet chamber upon the inlet side of the hot gases for the tubes located between the tube bottoms of the tube bundle. The additional tube bottom is arranged in such a way that both tube bottoms in the inlet chamber define another inlet chamber for colder, slag-free gases, which inlet chamber is accessible through an inlet in the shell of the tube bundle heat exchanger. The insertion tubes project far into, but not to the end of, the tubes of the tube bundle. The insertion tubes, with the outer tubes, form relatively narrow annular spaces suitable for generating high discharge speed. Four spiral formed strips respectively located in the annular spaces impart a twist to the gas flow discharging from the annular spaces to assure that gas discharging between the insertion tubes and the tubes of the tube bundle remain in flowing contact along the inner walls of the tubes. Slag-containing gas coming from a coal gasificatin reactor flows through an inlet into the inlet chamber of the tube bundle heat exchanger and is cooled off in three regions during flowing through the tube bundle heat exchanger whereby temperatures of the cooling-off gas are maintained in such a manner that slag is precluded from depositing upon the heat transfer surfaces while the gas is cooling off.

3 Claims, 2 Drawing Figures

X

HEAT EXCHANGER FOR COOLING SLAG-CONTAINING GASES FROM COAL GASIFICATION

The present invention relates to a heat exchanger for cooling slag-containing gases from coal gasification.

Gas from coal gasification reactors usually contains slag in gaseous, fluid or solid form. During cooling-off of the gases in the heat exchangers, for instance in waste-heat boilers for generation of steam, the slag is deposited on the heat transfer surface and considerably reduces the heat transfer. Especially the gaseous and fluid (droplet) formed slag incrusts the heat transfer surfaces by condensing and solidifying. Slag does not separate when the upper surface temperature of heat transfer surfaces lies above the condensation temperature of the slags. As soon as the gas is cooled to temperatures below the solidification point of the slag, the danger of incrusting likewise no longer exists.

With such heat exchangers, there is therefore necessary such a temperature decrease in the range or region of the cooling-off gas which precludes that the slag-containing gas comes into engagement with heat transfer surfaces in a temperature range or region of condensing as far as to the solidifying temperature of the slag, with the temperature being below the condensation temperature of the slag.

It is known to provide a radiation chamber with clad cooling tube walls, with which provision is made that the slag continuously condenses on the cladding and runs off and is brought to solidification at the bottom of the radiation chamber by engagement with water, while the gas which has given off its warmth or heat by radiation in the radiation chamber is carried away laterally. Such a radiation chamber has a very large space requirement and is correspondingly very costly.

It is therefore an object of the present invention to provide a heat exchanger having a small space requirement.

This object, and other objects and advantages of the present invention, will appear more clearly from the following specification in connection with the accompanying drawings, in which:

FIG. 4 is a schematic diagram to illustrate heat exchange using internal tube construction in three cooling regions according to the present invention.

Figures 1, 2, 3:
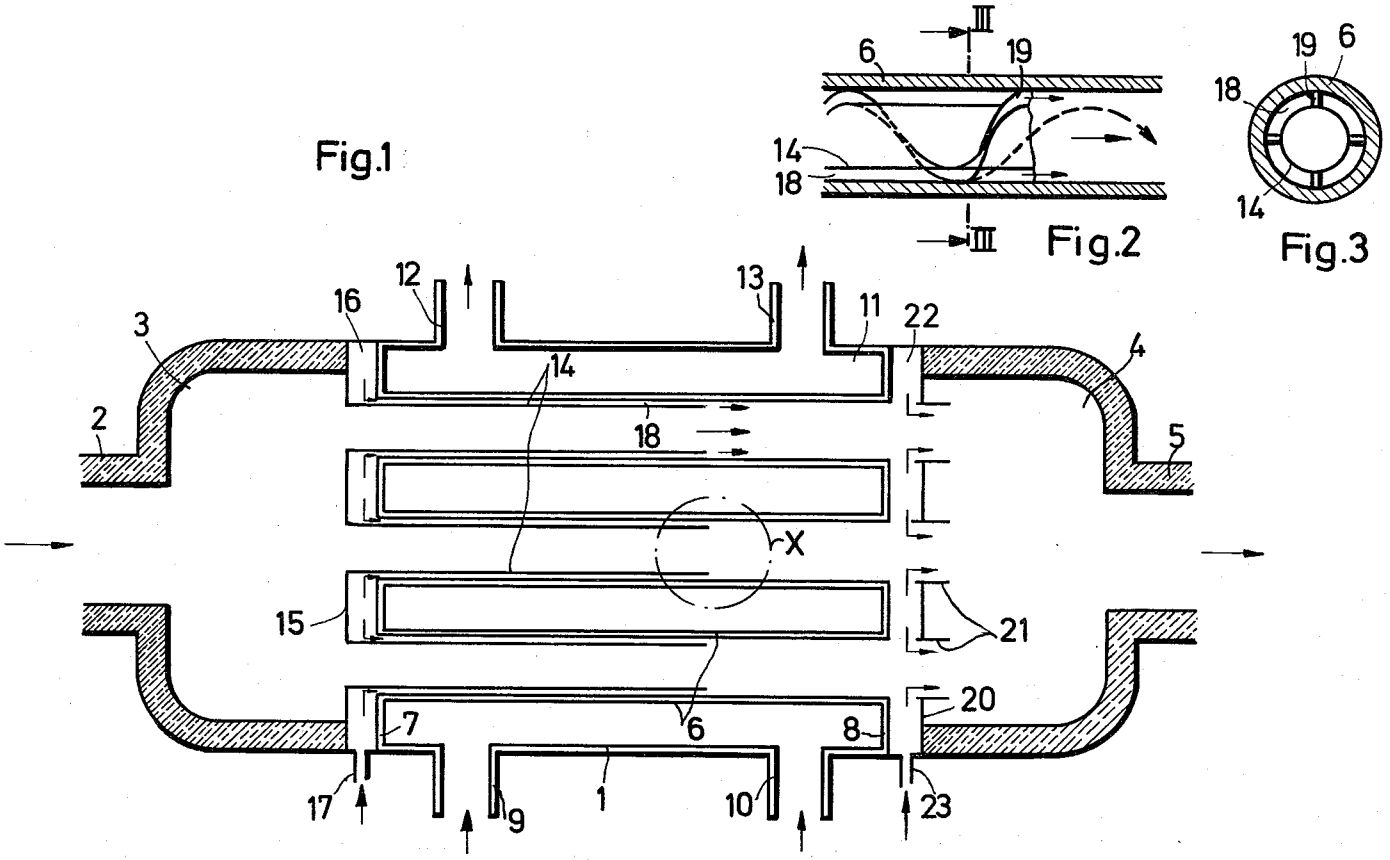
FIG. 1 shows a longitudinal section through a pipe bundle heat exchanger according to the present invention.
FIG. 2 shows in detail and in an enlarged sectional representation the encircled region X indicated in FIG. 1 and illustrated.
FIG. 3 shows a cross section taken along line III—III of FIG. 2.

The heat exchanger of the present invention is characterized primarily in that the heat exchanger is a pipe or tube bundle heat exchanger, according to which, in the inlet chamber thereof upon the intake side of the hot gases, an additional tube bottom with plug-in or insertion tubes for the tubes located between both tube bottoms of the tube bundle, is arranged in such a way that both tube bottoms in the inlet chamber define or limit another intake or inlet chamber for colder, slag-free gases, which chamber is accessible through an inlet in the shell of the tube bundle heat exchanger. The insertion tubes project far into, but not as far as the end of, the tubes of the tube bundle. The insertion tubes form relatively narrow annular chambers or spaces with the outer tubes, these annular spaces being suitable for generating a higher discharge speed. Features are provided by means of which the heated colder gas discharging from the spaces is kept along the inner walls of the tubes of the tube bundle. Further features are provided by means of which cooled-off gases discharge from the tubes of the tube bundle in such a way that they are subjected to further cooling-off.

To assure that the gas discharging from the annular spaces between the insertion tubes and the tubes of the tube bundle remains in flow engagement against the inner walls of the tubes, in accordance with a further embodiment of the present invention there are respectively arranged in the annular spaces, for example, four strips extending in a spiral form which impart a twist to the gas flow discharging from the annular space.

In order to guarantee that the cooled-off gases discharging from the tubes of the tube bundle are cooled off still further, a further tube bottom with tube supports or struts is so installed or built into the discharge chamber upon the output side of the cooled-off gases that the said tube bottom and the tube bottom of the tubes of the tube bundle define or limit an inlet chamber, for colder, slag-free gases, which is accessible through an inlet in the shell of the tube bundle heat exchanger. As a result, the colder slag-free gases entering at this location can flow mixingly or in a mixing manner into the flowing-away or discharging gases from the tubes of the tube bundle.

The advantages attained with the present invention consist especially therein that with a tube bundle heat exchanger there is utilized a heat exchanger having an especially smaller and less complex manner of construction for cooling the slag-containing gases, which provides possibilities for introducing colder slag-free gases into the annular spaces formed by the insertion tubes and the tubes of the tube bundle and also for imparting to the gases a twist, whereby the cooling-off and solid slag-forming gases cannot be incrusted upon the inner walls of the tubes. Furthermore, colder, slag-free gases can flow mixingly or in a mixing manner into the cooled-off gases discharging from the tubes of the tube bundle.

Referring now to the drawing in detail, the tube bundle heat exchanger has a shell 1, an inlet 2, an inlet chamber 3 for the supply of hot, slag-containing gases, a discharge chamber 4, and an outlet 5 for the discharge or carrying away of the cooled-off, slag-containing gases. The heat exchanger contains the tubes or pipes 6 as a pipe or tube bundle, through which the hot gases flow and which are fastened in the tube bottom 7 of the inlet chamber 3 and the tube bottom 8 of the discharge chamber 4. Cooling water enters the shell chamber 11 around the tubes 6 through the inlets 9 and 10, and the cooling water departs therefrom as a steam-water mixture through the outlets 12 and 13. The plug-in or insertion tubes 14 located in the tubes 6 are connected at one side or end thereof with the tube bottom 15 in the inlet chamber 3, in which connection both tube bottoms 7 and 15 are arranged at a predetermined spacing with respect to each other and form an inlet chamber 16 for colder slag-free gases, which flow in through the inlet 17 and pass into the annular spaces 18 between the plug-in or insert tubes 14 and the tubes 6. The annular spaces 18 have four spiral-formed strips 19 which extend from tube wall to tube wall and are distributed uniformly along the circumference. In the discharge chamber 4 there is installed next to the tube bottom 8 a further tube bottom 20 with tube supports 21. Both tube bottoms 8 and 20 form an inlet chamber 22 into which colder, slag-free gases pass through the inlet 23.

The slag-containing gas coming from a coal gasification reactor flows through the inlet 2 into the inlet chamber 3 of the tube bundle heat exchanger and is cooled off in three regions during flow through the tube bundle heat exchanger. By selection of the temperatures of the gases which are themselves cooling off, and by suitable measures as set forth in the following paragraphs, there is hindered or precluded that during the gas cooling off any separation of slag occurs upon the heat transfer surfaces.

In the first region of cooling-off, the hot slag-containing gas flows through the plug-in or insertion tube 14, while parallel thereto, colder, slag-free gas flows through the annular spaces 18. Under these circumstances, heat is transferred from hot gas through the insertion tube 14, through the colder gas in the annular spaces 18, and through the tube 6, with such transfer occurring to the cooling water in the shell chamber 11. By suitable measurement, there is assured that the upper surface temperature of the insertion tube 14 lies above the solidification temperature of the slag, and that accordingly an incrusting of the insertion tube 14 is precluded.

With progressing cooling off of the hot gases, however, upper surface temperature of the insertion tube would be obtained, at which an incrusting would begin. Therefore, in the second cooling region, the colder gas discharges from the annular spaces 18 and moves along the inner walls of the tubes 6. Since the discharge speed of the colder gas out of the annular spaces is greater than the speed of the hot gases in the tubes 6, the hot gases do not immediately engage the inner wall of the tubes 6. By way of the spiral-formed arrangement of strips 19 in the annular spaces 18, the colder gas flow has a twist imparted thereto. Because of the greater specific gravity (specific weight or unit of weight), compared with that of the hot gas, the rotating gas flow, accordingly also because of the centrifugal effect, remains relatively long at the inner wall of the tubes 6 and mixes itself first toward the end of the tubes 6 completely with the hot gas. In this second cooling region, the heat transporting of hot gas occurs directly through the colder gas to the tube 6 and accordingly to the cooling water. The slag solidifies in this region. The slag-free colder gas however precludes or hinders separation and depositing of slag upon the tube inner wall.

In the third cooling region, colder, slag-free gas is admixed through the inlet 23 into the inlet chamber 22 and further through the tube supports 21 to the discharging gases from the tubes 6. The now solidified slag is removed from the gas in a non-illustrated separator connected after or behind the tube bundle heat exchanger.

The present invention is, of course, in no way restricted to the specific disclosure of the specification and drawings, but also encompasses any modifications within the scope of the appended claims.

What we claim is:

1. A heat exchanger, especially a tube bundle heat exchanger for cooling slag-containing gases from coal gasification in at least three streams physically to control possible solidifying of gaseous slag which would deposit internally along cold tube walls to accumulate thick thereon in a short time, which comprises in combination:

a shell, at one end of which is located a first inlet for receiving hot slag-containing gases, and an inlet chamber for receiving hot gases from said inlet, and at the other end of which is located a discharge chamber for receiving cooled-off gases, and an outlet for receiving cooled-off gases from said discharge chamber for discharge of said gases from said shell;

first tube bottoms located in said inlet chamber;

second tube bottoms located in said discharge chamber;

tubes, in the form of a tube bundle, fastened in said first and second tube bottoms and adapted to receive hot gases therethrough, said tubes extending from said inlet chamber to said discharge chamber;

a second inlet located in said shell for receiving cooler slag-free gas;

third tube bottoms located in said inlet chamber, said third tube bottoms and said first tube bottoms being spaced from one another to form a first cooler slag-free gas inlet chamber, which is in communication with said second inlet for admixing said hot and slag-free gas;

insert tubes connected to tube bottoms belonging therewith and located within tubes belonging therewith, said insert tubes having a temperature above solidification temperature of the slag and extending from the inlet side of said tubes at least partially toward the outlet side thereof, said insert tubes being spaced from tubes belonging therewith to form narrow annular spaces therebetween which communicate with said first slag-free gas inlet chamber and which are adapted to generate high discharge speed;

means for keeping warmed-up cooler slag-free gas, which discharges from said narrow annular spaces, along the inner walls of said tubes; and means for further cooling of admixed gases discharging from said tubes.

2. A heat exchanger in combination according to claim 1, in which said means for keeping warmed-up cooler slag-free gas along the inner walls of said tubes include four spiral-like strips respectively arranged between tubes belonging therewith and insert tubes in the annular spaces belonging therewith for imparting a twist to exiting gas sweeping along inner walls of said tubes for a longer period of time.

3. A heat exchanger in combination according to claim 2, which includes a third inlet located in said shell for receiving cooler slag-free gas, and in which said means for further cooling of gases discharging from said tubes includes fourth tube bottoms with tube supports arranged in said discharge chamber and spaced from said second tube bottoms in such a way as to form a second cooler slag-free gas inlet chamber, which is in communication with said third inlet for mixing cooler slag-free gas with cooled-off gas discharging from said tubes.

* * * * *